United States Patent [19]

Hawkes

[11] 4,184,218

[45] Jan. 22, 1980

[54] BOOKBINDING

[75] Inventor: Charles V. Hawkes, Leatherhead, England

[73] Assignee: The Research Association for the Paper and Board, Printing and Packaging Industries, Leatherhead, England

[21] Appl. No.: 857,042

[22] Filed: Dec. 2, 1977

[30] Foreign Application Priority Data

Dec. 21, 1976 [GB] United Kingdom ..... 53264/76

[51] Int. Cl.[2] ..... B42C 9/00; B42D 1/00

[52] U.S. Cl. ..... 11/1 AD; 156/477 B; 281/21 R

[58] Field of Search ..... 11/1 AD, 3, 4, 1 R; 281/21 R; 156/477 B

[56] References Cited

U.S. PATENT DOCUMENTS

| | | | |
|---|---|---|---|
| 3,093,396 | 6/1963 | Segreto | 11/1 AD X |
| 3,840,254 | 10/1974 | Shatzkin | 281/21 R |
| 4,091,487 | 5/1978 | Axelrod | 11/1 AD |

*Primary Examiner*—Travis S. McGehee

*Attorney, Agent, or Firm*—Diller, Ramik & Wight

[57] ABSTRACT

A method of producing a fastback book including the steps of providing a block of pages and a cover for the block, both the block and the cover having a respective spine, the spine of the cover being thin compared with the front and back portions of the cover; and bonding the spine of the block to the spine of the cover.

10 Claims, 9 Drawing Figures

Figure 1:
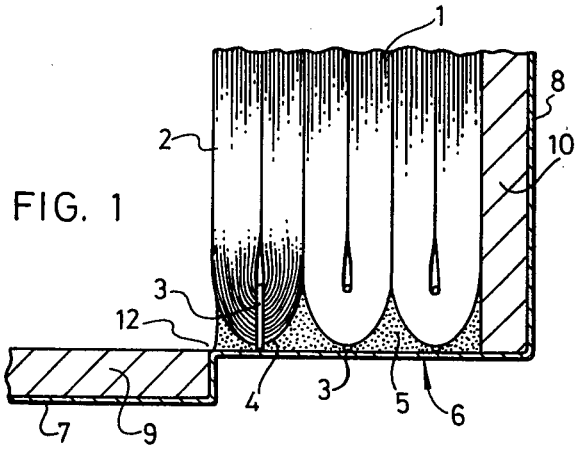

FIG. 4
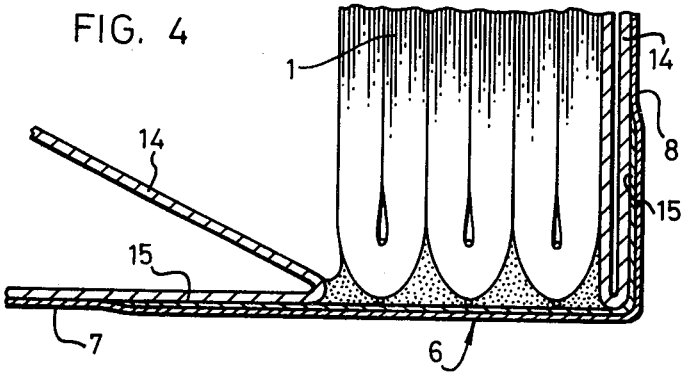
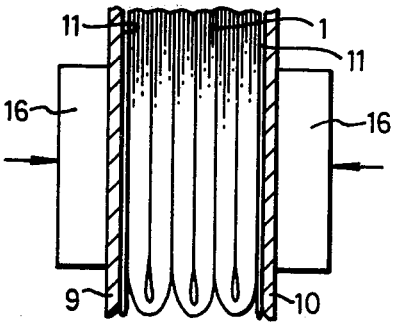
FIG. 5
FIG. 6
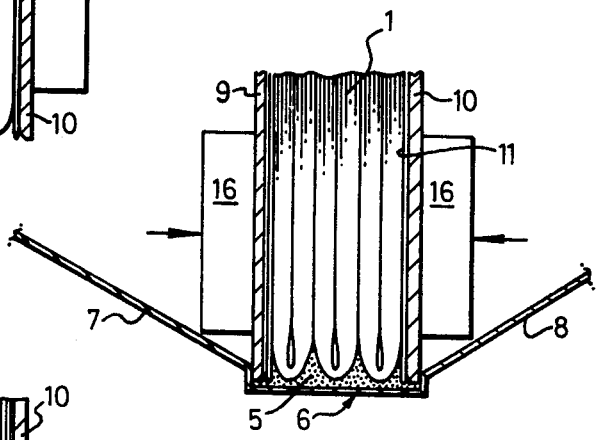
FIG. 7
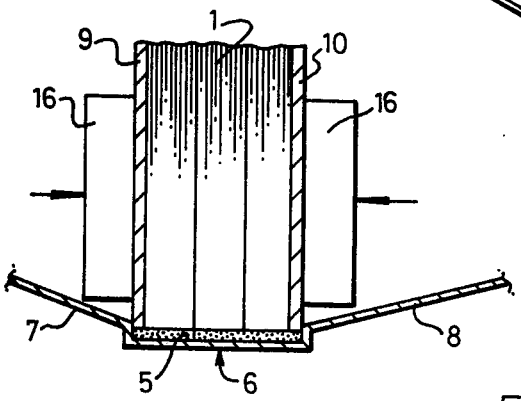
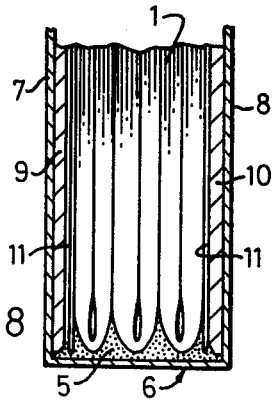
FIG. 8

BOOKBINDING

This invention relates to improvements in methods of binding books particularly in the field of fastbacks, i.e., books in which the entire spine of the book block is adhered directly to the cover.

Fastback books are generally bound in a paper cover. This may be attached by passing a block of clamped pages or sewn sections through a machine which applies a layer of adhesive along that edge of the book intended to form the spine. A paper cover, having a thickness of thin card, is then folded around the clamped block and pressure is applied to bond the spine of the cover to the spine of the block. The clamp on the block may then be released.

Whilst the paper cover is thicker than one of the pages of the block, it will not stand up to the same degree of wear and abuse as hard cover and often, after a short time, the spine will crack and the front and back portions will curl thereby ceasing to protect the pages of the book. The paper cover must be thick enough to give a reasonable degree of protection but increasing its stiffness reduces the flexibility of the spine and thus shortens the life of the book.

The alternative to these paper covered books is at present a cased in book. In such a book a book block consisting of bound sections, and a cover, are produced separately and then combined in an additional casing in process. Such books are not fastbacks since the cover is joined to the book block by flexible hinges at the sides of the spine. This results in a book with stiff covers and a flexible spine but which is more expensive to produce than a conventional fastback.

The main object of the present invention is to provide a simpler method of obtaining this combination of stiffness and flexibility.

In general, this object is achieved in a method of producing a fastback book including the steps of providing a block of pages and a cover for the block, both the block and the cover having a respective spine, the spine of the cover being thin compared with the front and back portions of the cover; and bonding the spine of the block to the spine of the cover.

When the front and back portions of the cover are reinforced with relatively stiff boards, the method preferably comprises the steps of clamping the boards and the block and drawing on a thin flexible cover which is bonded to the spine of the block and also to the boards. Suitably, the spine of the block or cover, together with the board backing surfaces of the cover, are coated with an adhesive before the cover is drawn on. A heat sensitive adhesive is preferably used so that (i) the spine is bonded to the cover by applying heat and pressure, (ii) the block and boards are subsequently released from a clamp—the spine then being bonded to the cover, and (iii) the board contacting surfaces of the cover are bonded to the boards by applying further heat and pressure. This last step finishes the process except for trimming the book to produce a flush cover.

Thus, according to a preferred embodiment of the invention, all of the book elements (such as cover boards, end papers and sections, and a cover) may be combined at one stage in the production of fastback books, for example, by using existing unsewn binding machines (such as Sulby, Sheridan or Muller machines).

In the case of sewn books bound with stiff covers, in this way it is advantageous to include a folded end paper as this results in a more easily opened cover, the hinge operating in the fold of the end paper rather than in the thick part of the adhesive layer. A similar result may be obtained by replacing the board and end paper with a folded card. The outside fold of the card is then combined with the covering material as a semi-stiff cover, and the inner fold provides a stout end paper on which could be fixed a date page or pocket for library use.

The pages of the book sections or signatures may be secured by metal loops as described in our U.K. Patent No. 1394162. In this case, open metal loops are inserted along the inner fold line, adjacent to the spine of each section or signature, the shanks of the loops being folded along the outer edge of the fold line and at least a part of each said loops being coated with a hot melt adhesive. Such loops, which may be looked on as "metal stitches", are cheaper to apply than the conventional linen stitches normally found in sewn bindings. They also provide a better key for adhesive used in bonding the spine of the cover to the spine of the block. However, the invention may be applied with conventional sewn bindings wherein the block comprises sections or signatures each secured by linen stitches.

When sewn or metal stitched sections are used together with folded endpapers it is advantageous to chamfer the inside edges of the boards adjacent to the spine. This has the effect of improving adhesion between the end paper and the board so that when the cover is opened the gap which would otherwise be apparent is covered.

If reinforcement of the hinge is required a strip of mull, wider than the spine of the book and previously treated with a heat sensitive adhesive, can be applied to the spine under the flexible cover. This may be drawn on together with the cover, or be applied separately at a position between an adhesive applicator and a covering station of a book binding machine. The method chosen will depend on the design of the machine used.

The invention also provides a book having a cover with a spine portion bonded to a block, the spine portion being thin compared with the front and back portions of the cover.

Figure 2:
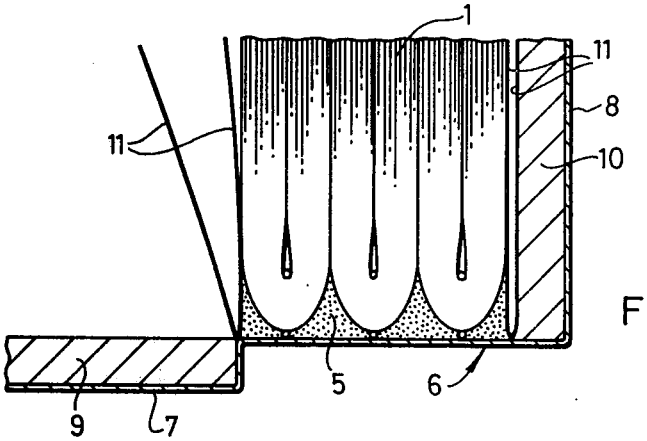
Figure 3:
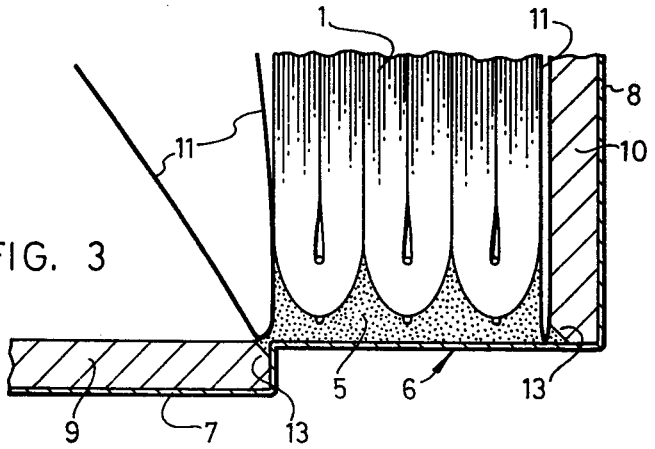

Embodiments of the invention will now be described with reference to the accompanying drawings, in which:

FIG. 1 shows one embodiment of the invention wherein stiff boards are bonded to a cover and metal stitched sections, FIG. 2 is a similar embodiment including a folded end paper to hide a gap along the inner edges of the cover boards, FIG. 3 is an embodiment similar to that of FIG. 2 showning boards with chamfered edges, FIG. 4 is an alternative embodiment wherein the boards and end papers have been replaced by folded cards.

Figure 9:
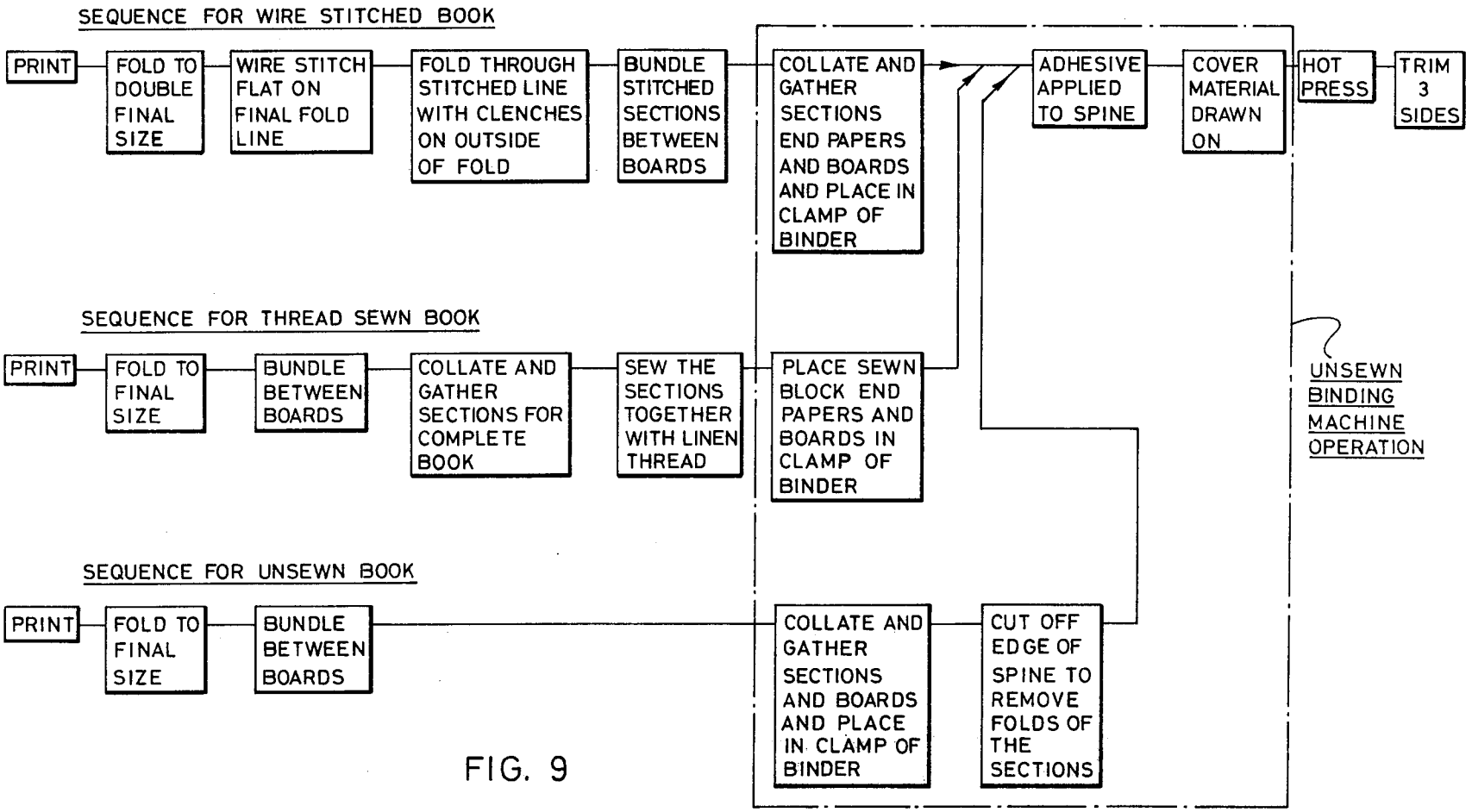

FIG. 5 shows the sewn or unsewn sections, end papers and boards as placed in the clamp of a binding machine, FIG. 6 shows the same elements including sewn sections after the adhesive has been applied and the flexible cover has been drawn on, but while the book is still in the clamp on the binder, FIG. 7 is similar to FIG. 6 but shows unsewn sections and boards after folds of the spine have been cut off, the adhesive applied, and the flexible cover drawn on, FIG. 8 shows a sewn book after binding and hot pressing to adhere the cover to the boards, but before trimming, and FIG. 9 is a flow diagram showing how the method of the invention is applied to wire stitched, thread sewn and unsewn books.

FIGS. 1–4 are end on views of respective books each having three sections 1 (for ease of illustration). More or less sections 1 may be provided depending on the content of the book.

In FIG. 1, the pages 2 of the first section have been drawn in to show how they are secured by wire loops or stitches 3 (seen in section) extending in spaced relationship along the inner fold 4 of each section. The inner folds 4 of each of the sections 1 are bonded by an adhesive 5 to the spine portion of an outer cover 6. Cover 6 has front and rear portions 7, 8 which are bonded to respective boards 9, 10. The front portion 7 and board 9, forming the front cover portion of the book, is shown open to illustrate the action of the spine. The cover may be made of paper, film laminated paper, cloth or plastics, or any other material which has sufficient flexibility and strength to be used as a spine for the book. The boards 9, 10 may be rigid or semi-rigid, and made from compressed paper, plastics or other material which will provide a reasonably hard casing To apply the cover to the block (comprising the three sections 1 as illustrated), the block may be clamped and the adhesive 5 applied along the edge which is to form the spine. The cover is then applied so that its spine portion abuts the spine portion of the block.

The finished book depends for its flexibility and quality of "laying-flat" on the thickness of the spine portion of the cover material 6 and on the film thickness and characteristics of the adhesive. Typical thicknesses of the cover material are in the region of 0.1 mm to 0.3 mm.

In the embodiment of FIG. 2, which is similar to that of FIG. 1, folded end papers 11 are located between the end sections and respective board 9, 10 at the front and rear of the book. These papers 11 hide a groove shaped gap 12 (FIG. 1) which is otherwise left between the end section and front and rear boards along the inner corners of the spine, and also improve the ease of opening of the covers.

FIG. 3 shows a similar embodiment to that of FIG. 2 except that the outer edges of section 1 do not abut the spine portion of the cover 6 and the boards 9, 10 have chamfers 13 adjacent the inner corners of the spine. The spacing of the sections 1 from the spine portion of the cover 6 has been shown in this embodiment only to illustrate that the thickness of the adhesive 5 may vary adjacent to the spine of the book. The adhesive is preferably of a type which is reasonably resilient when it sets so as to improve the flexibility of the spine. Although the adhesive is likely to be of the hot melt type other adhesives having the desired characteristics of strength and resilience could be employed. A thicker layer of adhesive 5, adjacent the spine, is preferable when the material of cover 6 is very thin or somewhat weak. The chamfers 13 assist in promoting the "lay-flat" quality of the book since the inner corners of the boards 9, 10 tend to apply a compressive force across the spine as the book is opened. When end papers 11 are included the chamfer also has the effect of increasing the area of adhesion of these papers.

In the embodiment of FIG. 4 folded cards 14 replace the boards shown in the other figures. The outside halves of the cards are bonded to the front and rear portions 7, 8 of a cover 6. A narrow strip of mull, 15 previously treated with a heat sensitive adhesive lies between the cards 14 and the cover and reinforces the hinges. The mull could also be included if boards are used instead of folded cards to stiffen the front and rear of the cover.

FIGS. 5–8 illustrate various stages in binding a book having a block with stitched or cut sections. In FIG. 5, three stitched sections 1 together with folded end papers 11 and boards 9, 10 are placed in a clamp 16. The pressure applying members of the clamp 16 extend as close as possible adjacent the spine of the block (for example, within $\frac{3}{8}''$ of the edge of boards 9, 10) so that the edges of boards 9, 10 hold the spine of the block together and prevent any splaying or mushrooming. FIG. 6, shows the same elements after an adhesive 5 has been applied and a flexible cover 6, 7, 8 has been drawn on whilst the book is still in the clamp of a binding machine, (not shown). FIG. 7 shows the same stage of operation with the book having unsewn sections 1 and boards 9, 10 after the folds of the spine have been cut off, adhesive 5 has been applied and cover 6, 7, 8 has been drawn on. FIG. 8 shows a sewn book after binding and hot pressing to adhere the cover 6, 7, 8 to the boards 9, 10, but before trimming.

FIG. 9 is a flow diagram which is self-explanatory, showing how the invention is applied in order to bind wire stitched, thread sewn and unsewn books.

What we claim is:

1. A method of producing a fastback book including the steps of providing a block of pages and a cover for the block, both the block and the cover having a respective spine, the spine of the cover being thin and flexible compared with the front and back portions of the cover, bonding the spine of the block to the spine of the cover, the front and back portions of the cover being reinforced with boards, the method further including the steps of clamping the block and the boards, drawing on a flexible cover, which cover is thinner than either of the boards and bonding said cover to the block spine and to the boards.

2. A method according to claim 1 wherein said bonding step is performed by coating the spine of the block and the board backing surfaces of the cover with a heat sensitive adhesive, and then drawing on the cover.

3. A method according to claim 2 wherein said bonding step is performed by (i) bonding the block spine to the cover by applying heat and pressure (ii) subsequently releasing the clamps which clamp together the block and boards and (iii) bonding the board contacting surfaces of the cover to the boards by applying further heat and pressure.

4. A method according to claim 3 including the step of finally trimming the book to produce a flush cover.

5. A method according to claim 1 comprising the step of including a folded end paper at the front and the back of the block whereby each hinge of the book operates in the fold of the respective end paper.

6. A method according to claim 5 wherein the inside edges of the boards adjacent the spine are chamfered.

7. A method according to claim 1 wherein said bonding step is performed by coating the spine of the cover and the board backing surfaces of the cover with a heat sensitive adhesive.

8. A method of producing a fastback book including the steps of providing a block of pages and a cover for the block, both the block and the cover having a respective spine, the spine of the cover being thin and flexible compared with the front and back portions of the cover, bonding the spine of the block to the spine of the cover, the pages of sections or signatures forming the block are secured by metal loops inserted along respective inner fold lines, adjacent the spine of each section or signature, the shanks of the loops being folded along the outer edge of the fold line and at least a part of each of said loops being coated with a hot melt adhesive.

9. A method of producing a fastback book having a block of sewn signatures, the method including the steps:

(a) placing boards one at each side of said block of sewn signatures;
(b) securing said boards and said block in a clamp;
(c) providing a cover;
(d) applying a single layer of heat sensitive adhesive to the spine of said cover and to board backing surfaces of said cover;
(e) applying said cover to said block spine;
(f) applying heat and presure to adhere said cover to said block spine;
(g) releasing said clamp and applying said board backing surfaces of said cover to the respective surfaces of said boards:
(h) applying heat and pressure to adhere said cover to said boards;
(i) trimming the book to produce a flush cover; whereby in the book so produced the spine of said cover is thin compared with the front and back portions of said cover.

10. A method of producing a fastback book having a block of sewn signatures, the method including the steps:

(a) placing boards one at each side of said block or sewn signatures;
(b) securing said boards and said block in a clamp;
(c) providing a cover;
(d) applying a single layer of heat sensitive adhesive to the spine of said block and to board backing surfaces of said cover;
(e) applying said cover to said block spine;
(f) aplying heat and pressure to adhere said cover to said block spine;
(g) releasing said clamp and applying said board backing surfaces of said cover to the respective surfaces of said boards;
(h) applying heat and pressure to adhere said cover to said boards;
(i) trimming the book to produce a flush cover; whereby in the book so produced the spine of said cover is thin compared with the front and back portions of said cover.

* * * * *